US008435192B2

(12) United States Patent
Belin

(10) Patent No.: US 8,435,192 B2
(45) Date of Patent: May 7, 2013

(54) EXERCISE DEVICE WITH KNEE REST

(76) Inventor: George E. Belin, Branson, MO (US)

( * ) Notice: Subject to any disclaimer, the term of this patent is extended or adjusted under 35 U.S.C. 154(b) by 0 days.

(21) Appl. No.: 13/463,338

(22) Filed: May 3, 2012

(65) Prior Publication Data

US 2012/0220906 A1 Aug. 30, 2012

Related U.S. Application Data

(63) Continuation of application No. 13/312,747, filed on Dec. 6, 2011.

(60) Provisional application No. 61/420,172, filed on Dec. 6, 2010.

(51) Int. Cl.

| | |
|---|---|
| ***A61H 1/00*** | (2006.01) |
| ***A61H 1/02*** | (2006.01) |
| ***A61H 5/00*** | (2006.01) |
| ***A63B 24/00*** | (2006.01) |
| ***A63B 23/08*** | (2006.01) |
| ***A63B 23/10*** | (2006.01) |
| ***A63B 26/00*** | (2006.01) |

(52) U.S. Cl.
USPC ..... 601/34; 601/23; 482/4; 482/79; 482/142

(58) Field of Classification Search ..... 482/142, 482/4, 79–80; 601/5, 23–24, 27–31, 33–35, 601/84, 89–93, 97–98, 101, 103–104; 602/5, 602/23, 26–29
See application file for complete search history.

(56) References Cited

U.S. PATENT DOCUMENTS

| | | | | | |
|---|---|---|---|---|---|
| 4,583,555 | A * | 4/1986 | Malcom et al. | 600/595 |
| 4,733,859 | A * | 3/1988 | Kock et al. | 482/79 |
| 4,913,163 | A * | 4/1990 | Roger et al. | 600/595 |
| 4,949,712 | A * | 8/1990 | Torii | 601/35 |
| 4,969,471 | A * | 11/1990 | Daniel et al. | 600/587 |
| 5,025,802 | A * | 6/1991 | Laico et al. | 128/882 |
| 5,063,918 | A * | 11/1991 | Guhl | 602/40 |
| 5,107,822 | A * | 4/1992 | Ohashi | 601/23 |
| 5,156,163 | A * | 10/1992 | Watkins et al. | 600/595 |
| 5,221,242 | A * | 6/1993 | Weber et al. | 482/79 |
| 5,290,220 | A * | 3/1994 | Guhl | 602/33 |
| 5,417,644 | A * | 5/1995 | Lee | 601/98 |
| 5,419,753 | A * | 5/1995 | Wang | 601/84 |
| 5,468,215 | A * | 11/1995 | Park | 601/23 |
| 5,489,257 | A * | 2/1996 | Li | 601/98 |
| 6,013,039 | A * | 1/2000 | Watkins et al. | 600/595 |
| 6,285,144 | B1 * | 9/2001 | Shih | 318/15 |
| 6,342,042 | B1 * | 1/2002 | Martin | 601/93 |
| 6,491,650 | B2 * | 12/2002 | Huang | 601/35 |
| 6,511,447 | B1 * | 1/2003 | Huang | 601/28 |
| 6,572,568 | B2 * | 6/2003 | Huang | 601/29 |
| 6,685,658 | B1 * | 2/2004 | Dietz et al. | 601/5 |
| 7,241,271 | B2 * | 7/2007 | Kurata et al. | 601/34 |
| 7,976,482 | B2 * | 7/2011 | Mayr | 600/595 |
| 2003/0060339 | A1 * | 3/2003 | Ravikumar et al. | 482/80 |
| 2008/0276375 | A1 * | 11/2008 | Gehrke | 5/648 |

* cited by examiner

*Primary Examiner* — Loan Thanh
*Assistant Examiner* — Shila Jalalzadeh Abyane
(74) *Attorney, Agent, or Firm* — Merchant & Gould P.C.

(57) ABSTRACT

An exercise device is disclosed. The exercise device includes an ankle rest structure and a housing. Within the housing, a drive mechanism is provided that is connected to the ankle rest structure. The drive mechanism moves the ankle rest in a reciprocating motion along a generally horizontal plane. The exercise device also includes a knee rest structure spaced away from the ankle rest and connected to the housing. In one embodiment, the knee rest is movable in a horizontal and vertical direction with respect to the housing.

5 Claims, 17 Drawing Sheets

EXERCISE DEVICE WITH KNEE REST

RELATED APPLICATIONS

This application is a continuation of application Ser. No. 13/312,747, filed Dec. 6, 2011, which claims benefit of a Provisional Patent Application Ser. No. 61/420,172, filed Dec. 6, 2010, which applications are incorporated by reference in their entireties.

BACKGROUND

Therapeutic exercise devices utilizing reciprocating ankle rests are known. In use, a person will lie flat on his back and place his ankles on the ankle rest. In operation, the ankle rest reciprocates horizontally in a side-to-side motion which causes the legs to swing back and forth. During this time, a person's legs are suspended above the floor or surface on which the person is resting such that the back of the knee is not supported by the exercise device. Improvements are desired.

SUMMARY

An exercise device is disclosed. The exercise device includes an ankle rest and a knee rest, both of which are connected to a housing. Within the housing, a drive mechanism is provided that is connected to the ankle rest. The drive mechanism moves the ankle rest in a reciprocating motion along a generally horizontal plane. The knee rest is spaced away from the ankle rest and is movable in a horizontal and vertical direction with respect to the housing. In one embodiment, the position of the knee rest is adjustable relative to the longitudinal axis of the ankle rest. In one embodiment, the knee rest is adjustable in a vertical direction relative to the longitudinal axis of the ankle rest. In one embodiment, the knee rest is adjustable in a horizontal direction relative to the longitudinal axis of the ankle rest. In one embodiment, the knee rest is adjustable in both the horizontal and vertical directions. The knee rest may also have a contoured top surface and have a width that is equal to or greater than the width of the ankle rest.

DETAILED DESCRIPTION

Reference will now be made in detail to the exemplary aspects of the present disclosure that are illustrated in the accompanying drawings. Wherever possible, the same reference numbers will be used throughout the drawings to refer to the same or like structure.

Figure 1:
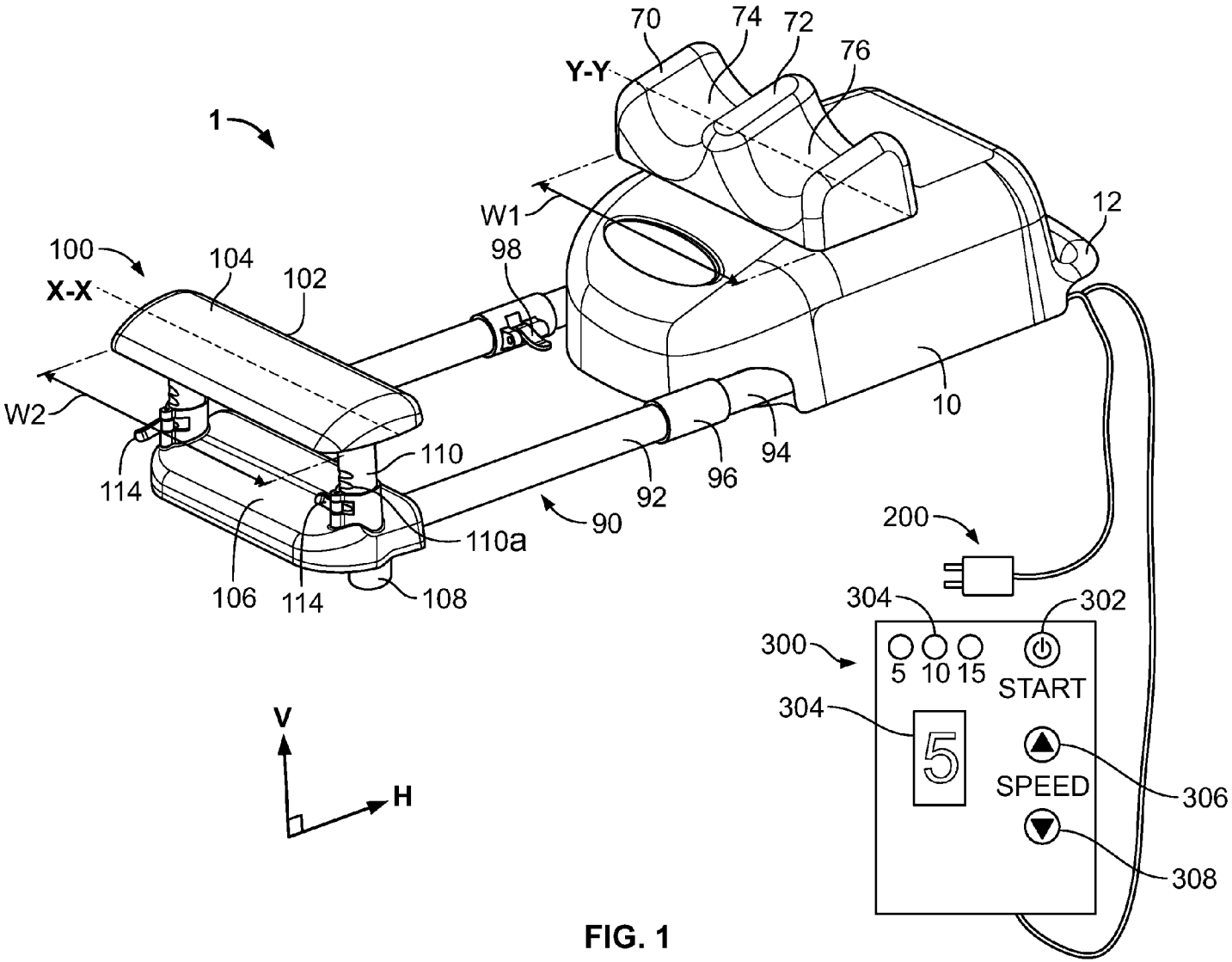
FIG. 1 is a front perspective view of an exercise device in accordance with the concepts presented herein.
Figure 2:
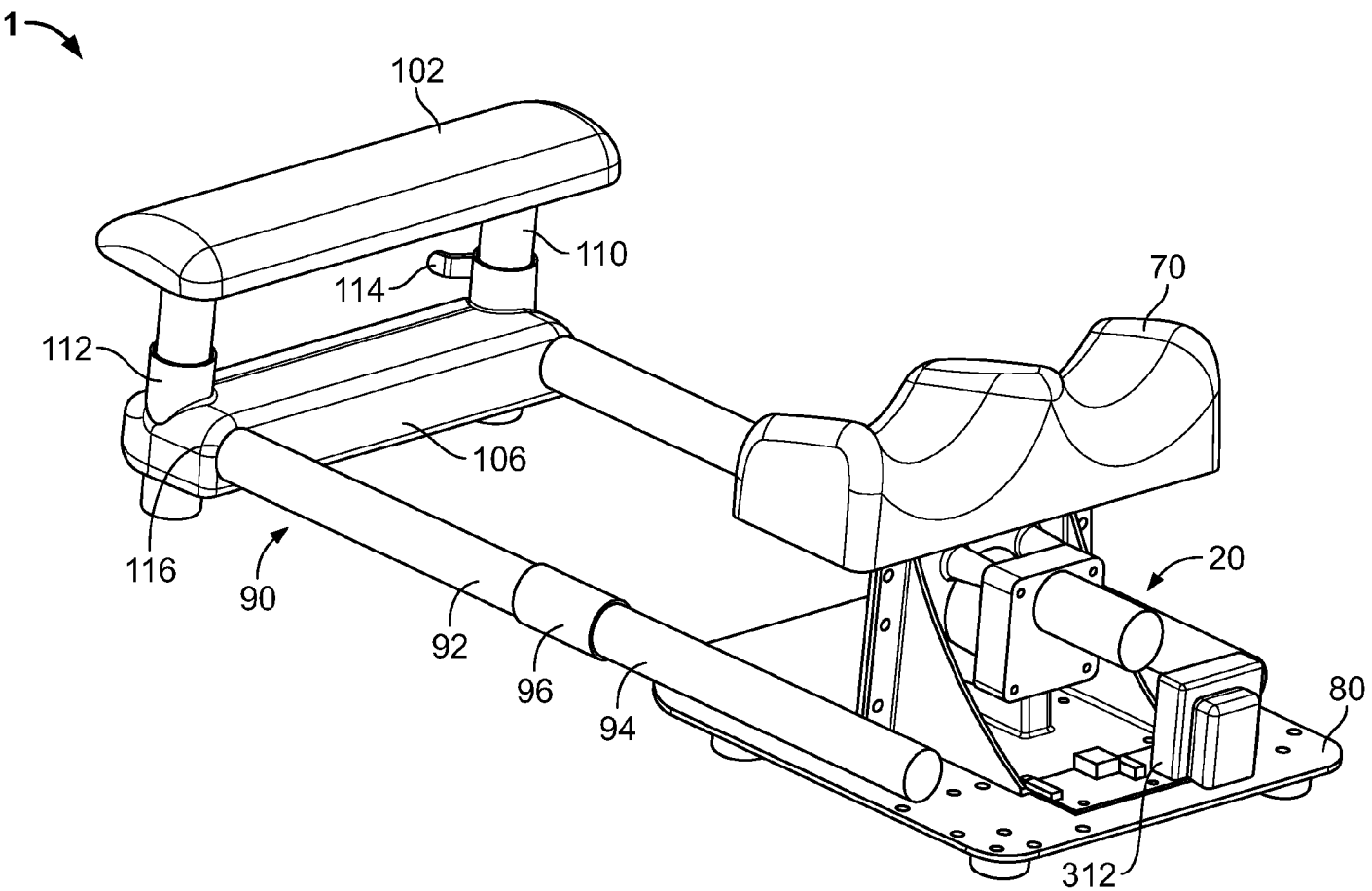
FIG. 2 is a rear perspective view of the exercise device shown in FIG. 1 with the housing removed.
Figure 3:
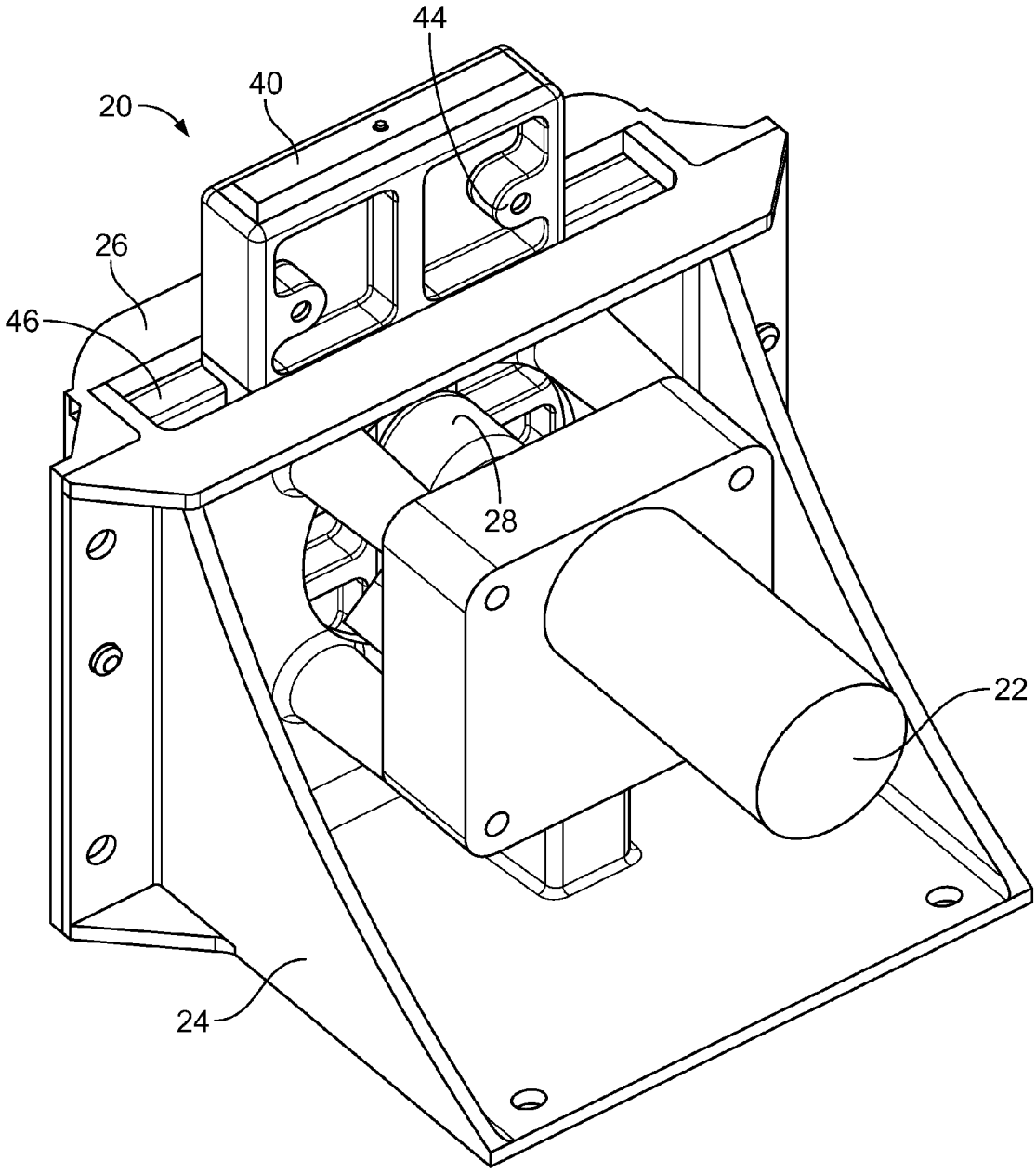
FIG. 3 is a rear perspective view of the drive mechanism shown in FIG. 2.
Figure 4:
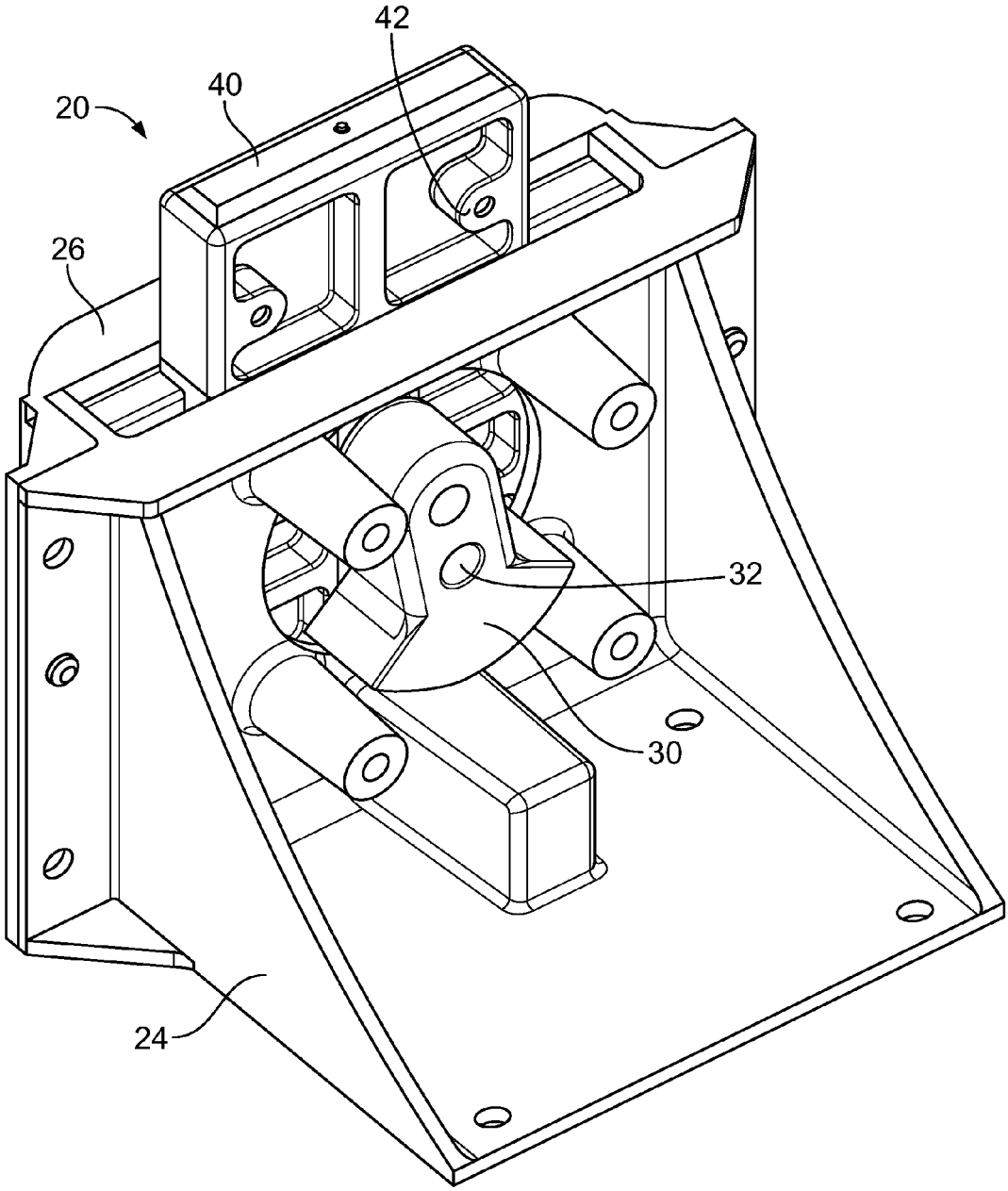
FIG. 4 is a rear perspective view of a portion of the drive mechanism shown in FIG. 2.

Referring to FIG. 1, an exercise device 1 is shown. In one embodiment, exercise device 1 has a housing 10 and a handle 12. Housing 10 is for providing an aesthetic appearance to the exercise device 1 and also for protecting a drive mechanism 20, discussed later. Handle 12 is for transporting the exercise device 1 and is shown as being integrally molded into the housing 10. In the particular embodiment shown, housing 10 and handle 12 are constructed from ABS plastic. However, other materials may be used.

Figure 8:
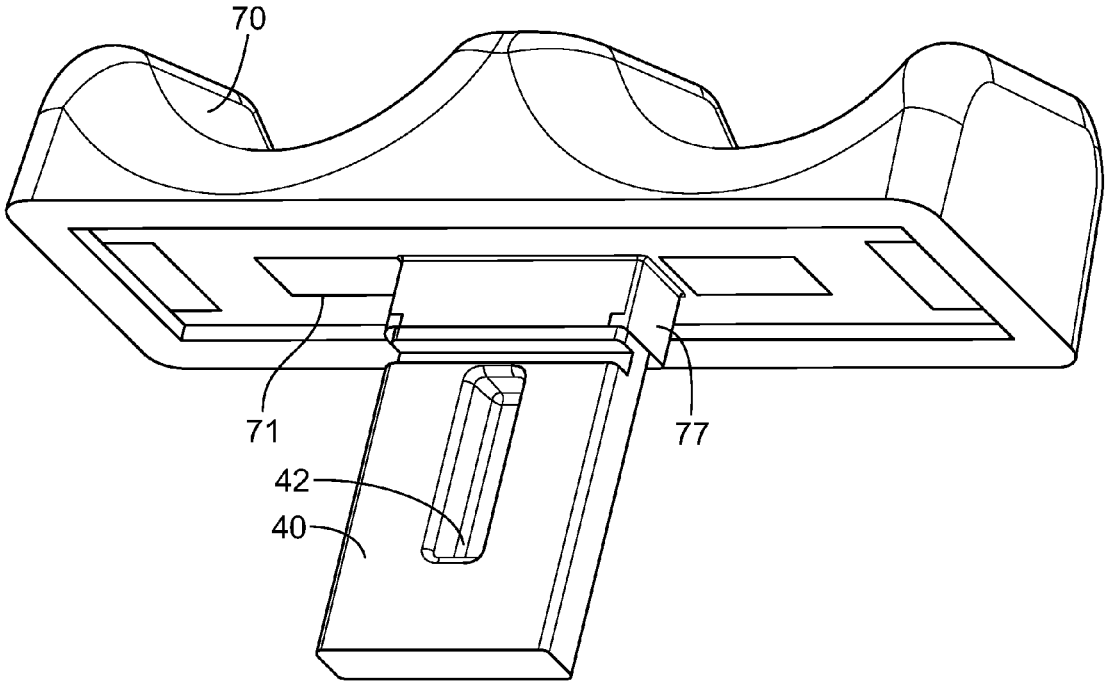
FIG. 8 is a front perspective view of an ankle rest and slide member of the exercise device shown in FIGS. 1 and 2.
Figure 9:
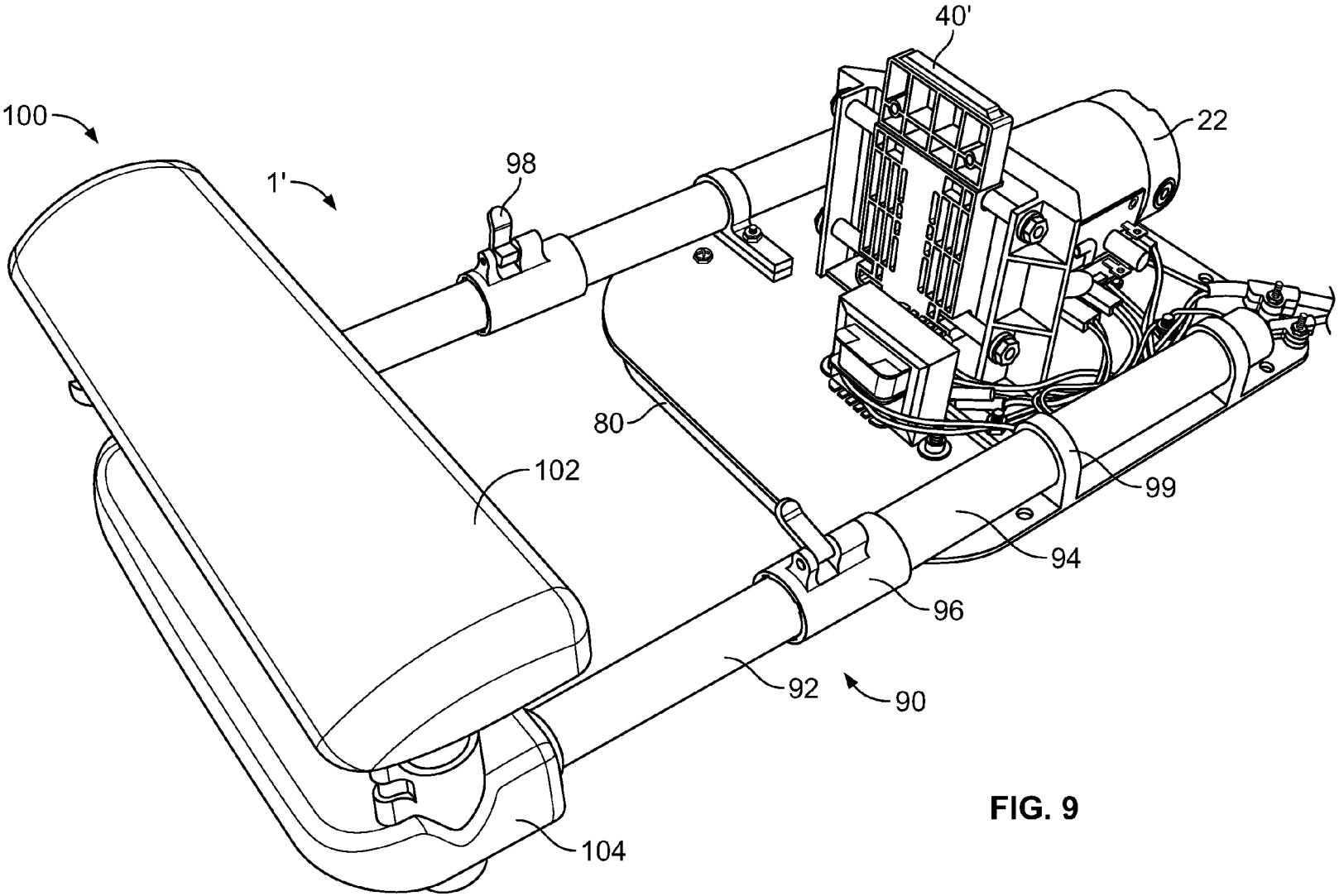
FIG. 9 is a rear perspective view of a second embodiment of an exercise device in accordance with the concepts presented herein.

Still referring to FIG. 1, exercise device 1 is further shown as having an ankle rest 70. Ankle rest 70 is for imparting a side-to-side motion onto a user's legs via the ankles of the user. This motion may reduce the unnatural twist and flex forces of the joints between the ankles and hips of the body. To facilitate this, ankle rest 70 is provided with a top surface 72 having a pair of recesses 74, 76 within which a user may place his or her ankles. The ankle rest 70 also has a width W1 that is sufficient to ensure that the recesses are able to be sufficiently spaced apart. In the embodiment shown, W1 is about 12 inches. In operation, the ankle rest 70 reciprocates in a direction in line with a longitudinal axis Y-Y of the ankle rest. The longitudinal axis Y-Y is generally perpendicular to a length of the user's legs. In the particular embodiment shown, ankle rest 70 has a molded foam construction to minimize point pressure on the user. However, other materials may be utilized. As can be seen in FIG. 8, ankle rest 70 also has a structural frame 71 that includes a receiving portion 77. Receiving portion 77 is for receiving a slide member 40 of the drive mechanism 20, discussed later. The receiving portion 77 and the slide member 30 may be connected to each other by any means known in the art, such as by screws received in a pair of recesses 44 in the slide member 40.

Figure 5:
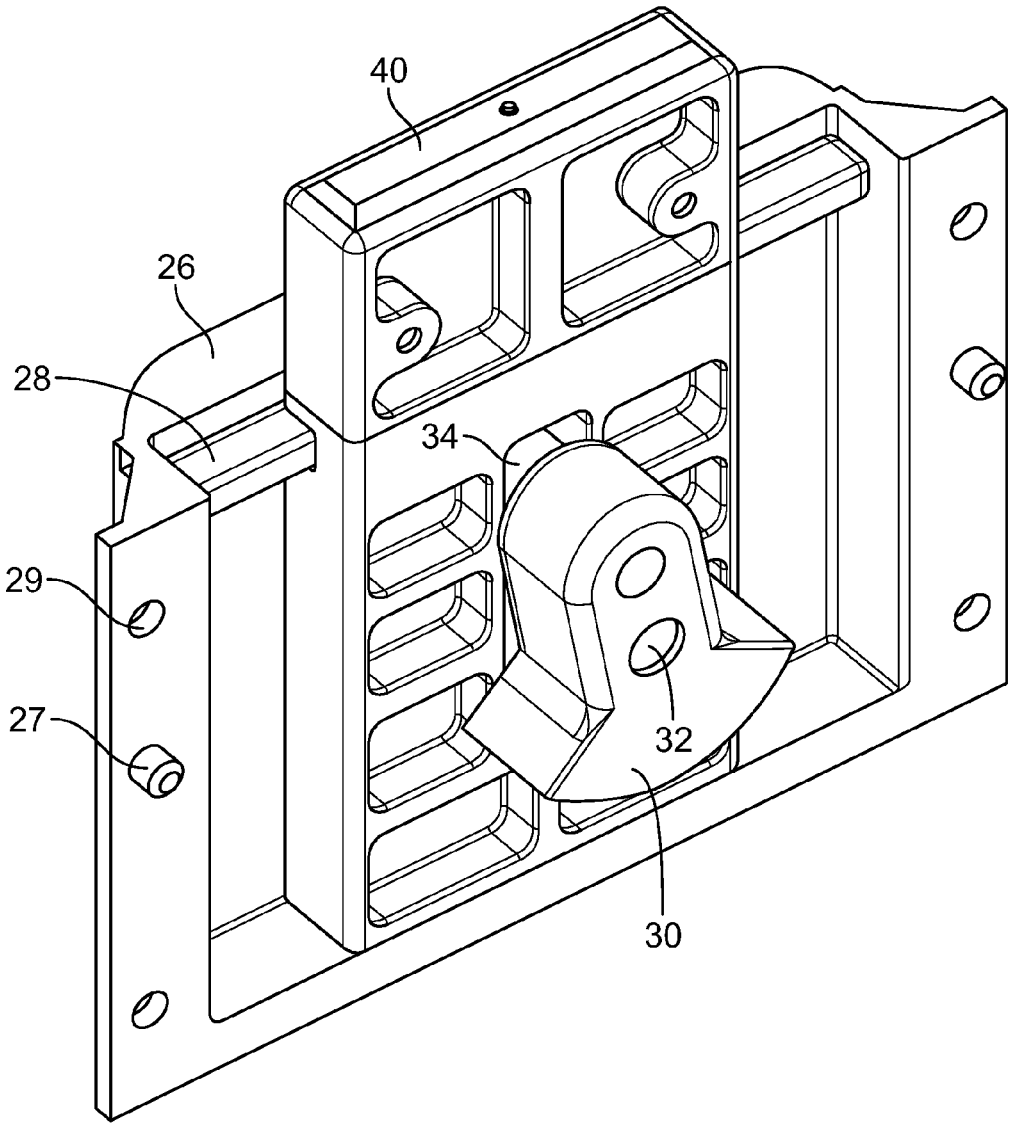
FIG. 5 is a rear perspective view of a portion of the drive mechanism shown in FIG. 2.

Referring to FIGS. 2-8, ankle rest 70 is reciprocated by a drive mechanism 20 mounted to a base plate 80 of the exercise device 1. As shown, drive mechanism 20 includes a motor 22 supported by a first frame member 24. Connected to the shaft of the motor 20 is a cam arm 30. Cam arm 30 has a bore 32 for receiving the shaft of the motor 20 and also has a drive pin 34 that is offset from the bore 32. Drive pin 34 is received within a slot 42 of the slide member 40. As the motor 20 rotates the cam arm 30, the drive pin moves vertically within slot 42 and causes slide member 40 to reciprocate in a direction normal to the length of the slot 42. As can be best seen in FIG. 8, the length of slot 42 is perpendicular to the longitudinal axis Y-Y of the ankle rest 70. Due to this configuration, the rotation of motor 20 will cause the slide member 40 to reciprocate in a direction parallel to the longitudinal axis Y-Y of the ankle rest 70. Referring to FIG. 5, it can be seen that cam arm 30 may also be shaped such to have a counterweight such that the rotation of the cam arm 30 does not cause vibration.

In order to sufficiently restrain the slide member 40 such that the slide member 40 can only move in a linear direction, at least one slide bar 28 is provided that engages with a corresponding slot 46, or optionally a bore, within the slide member 40. As can be seen, slide bar 28 and slot 46 are parallel to longitudinal axis Y-Y. In one embodiment, a second slide bar 28 and slot or bore 46 are provided below the slot 42 to additionally secure the slide member 40.

Figure 6:
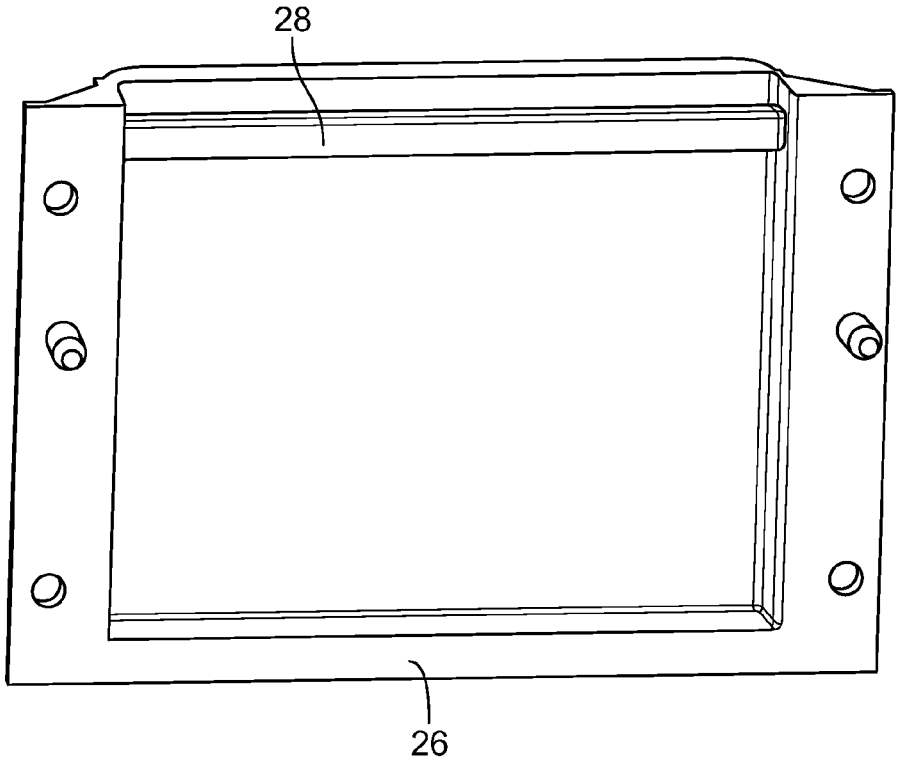
FIG. 6 is a rear perspective view of a frame member of the drive mechanism shown in FIG. 2.

Referring to FIGS. 5 and 6, it can be seen that slide bar 28 is attached to a second frame member 26. Second frame member 26 engages with first frame member 24 to ensure that the slide member is further secured and constrained to move only along a direction parallel to the Y-Y axis. The second frame member 26 may be secured to the first frame member 24 by bolts passing through common recesses 29. The second frame 26 is also shown as being provided with alignment pins 27 that engage with corresponding recesses in the first frame member 24 to ensure that proper alignment is achieved. Optionally, the slide bar(s) 28 and the slide member 40 may be retained onto the first frame member 24 without the use of a second frame member 26, as shown in FIGS. 9-19.

Figure 14:
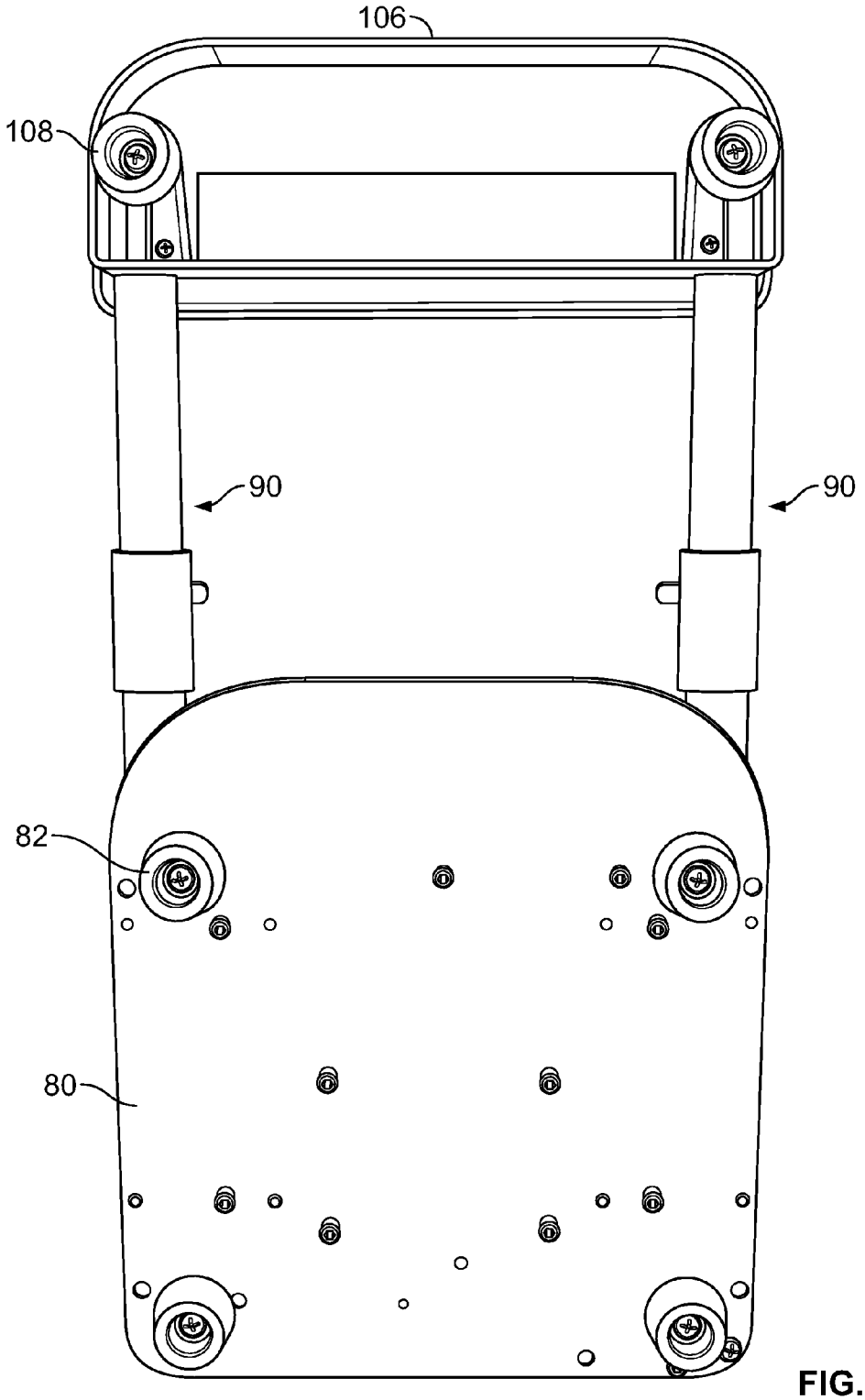
FIG. 14 shows a bottom view of the exercise device shown in FIG. 9.
Figure 15:
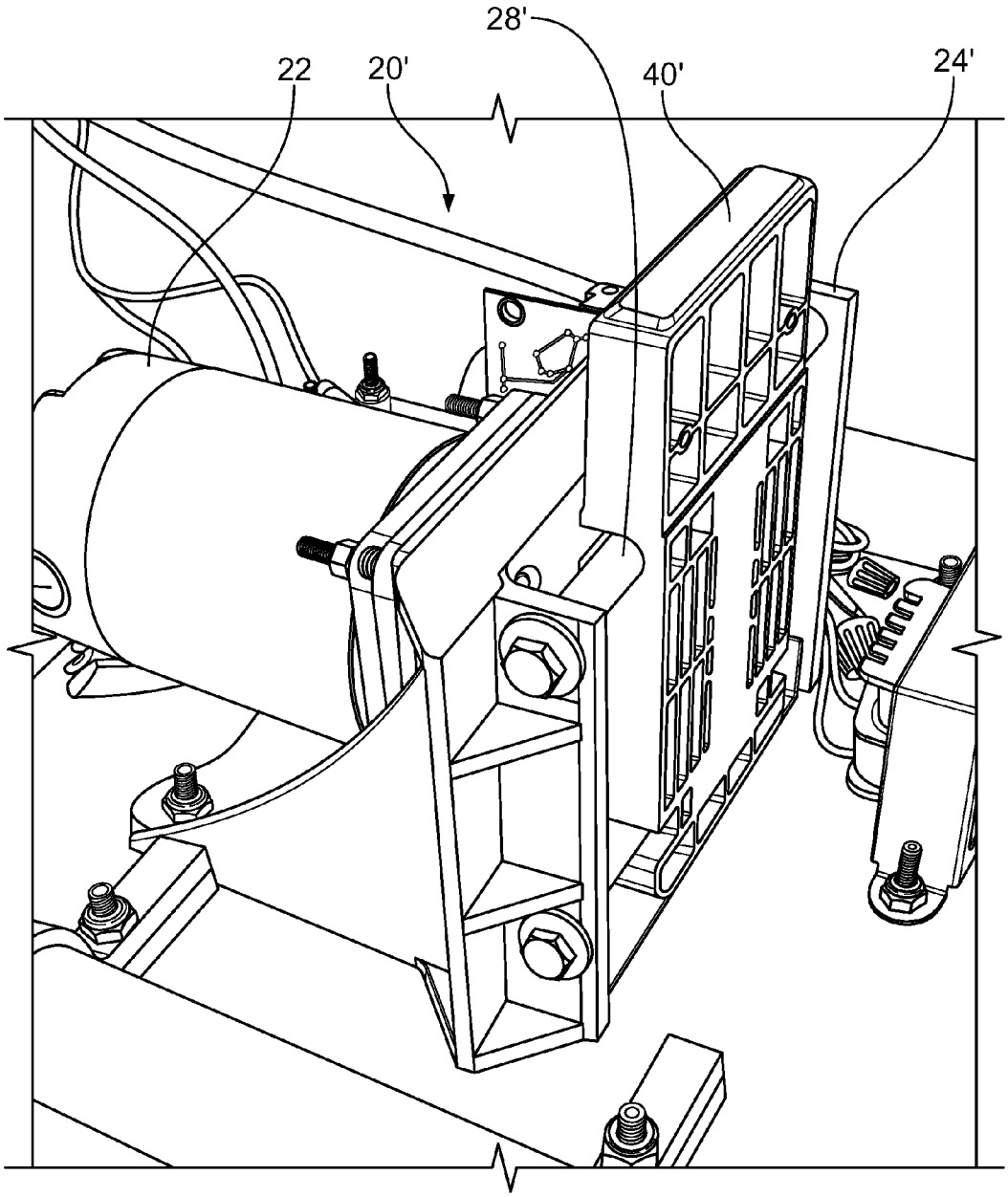
FIG. 15 shows a perspective view of the drive mechanism for the exercise device shown in FIG. 9.
Figure 16:
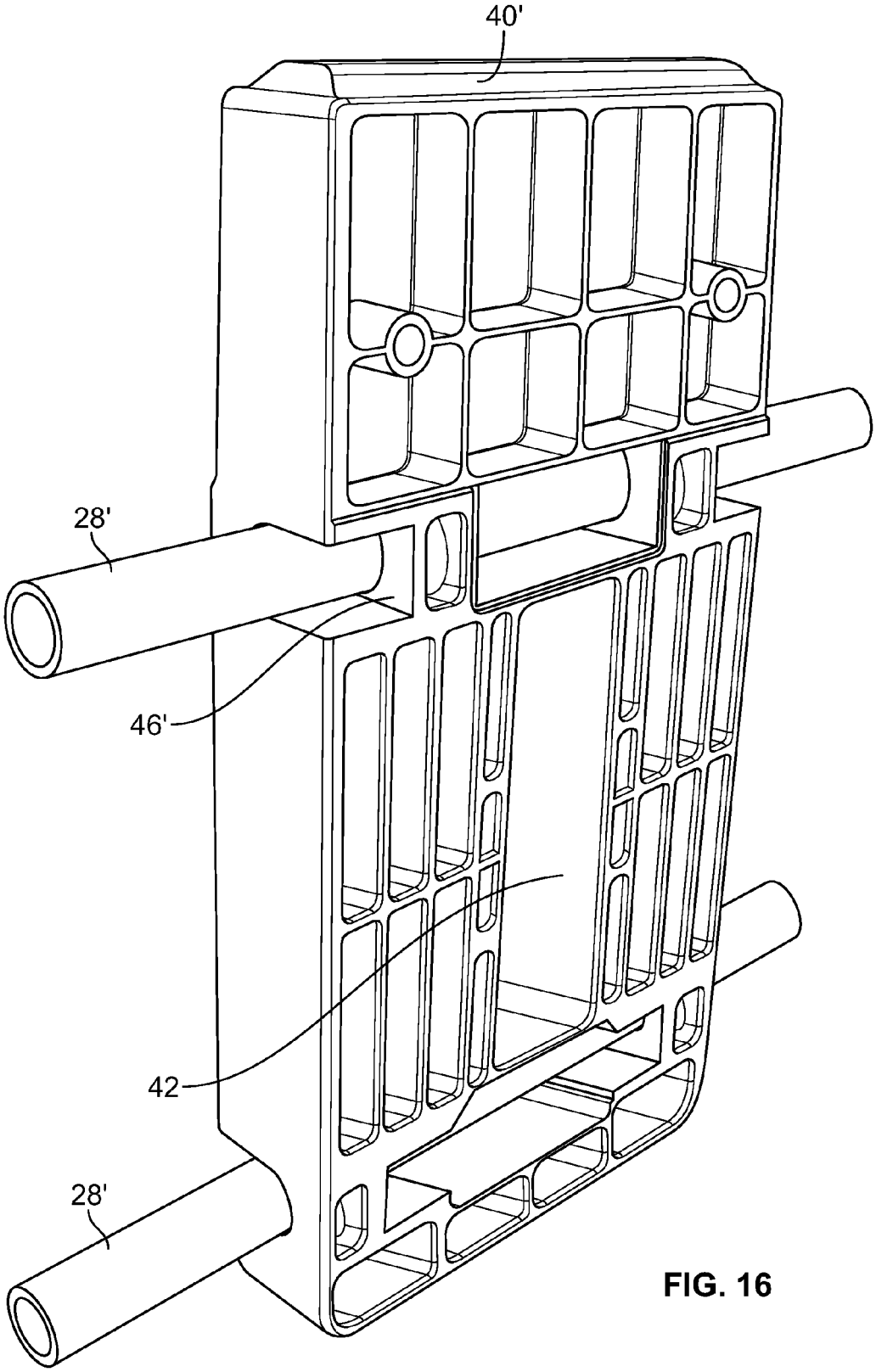
FIG. 16 shows a perspective view of the slide member and slide bars of the drive mechanism shown in FIG. 15.
Figure 17:
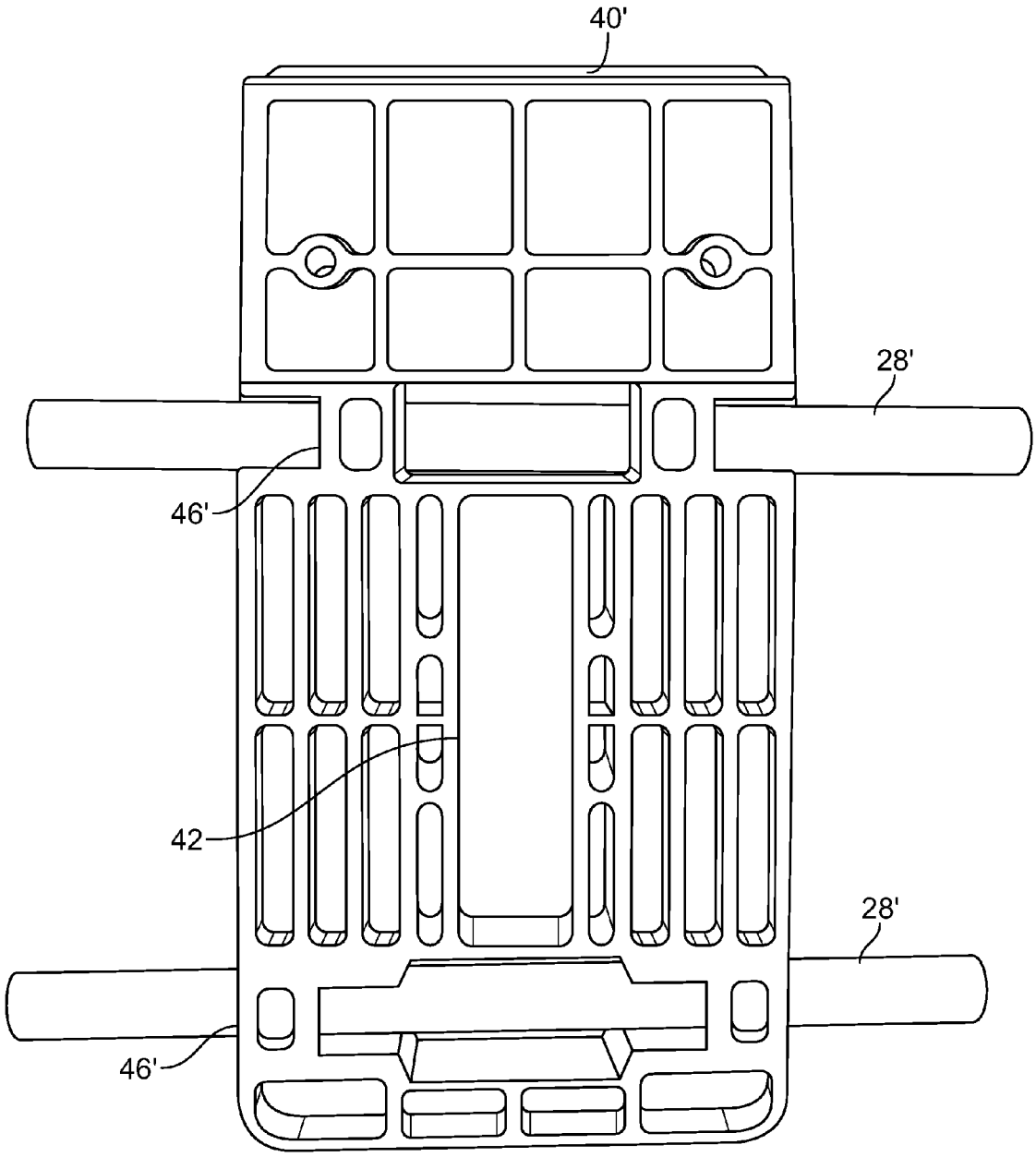
FIG. 17 shows a front view of the slide member and slide bars of the drive mechanism shown in FIG. 15.
Figure 18:
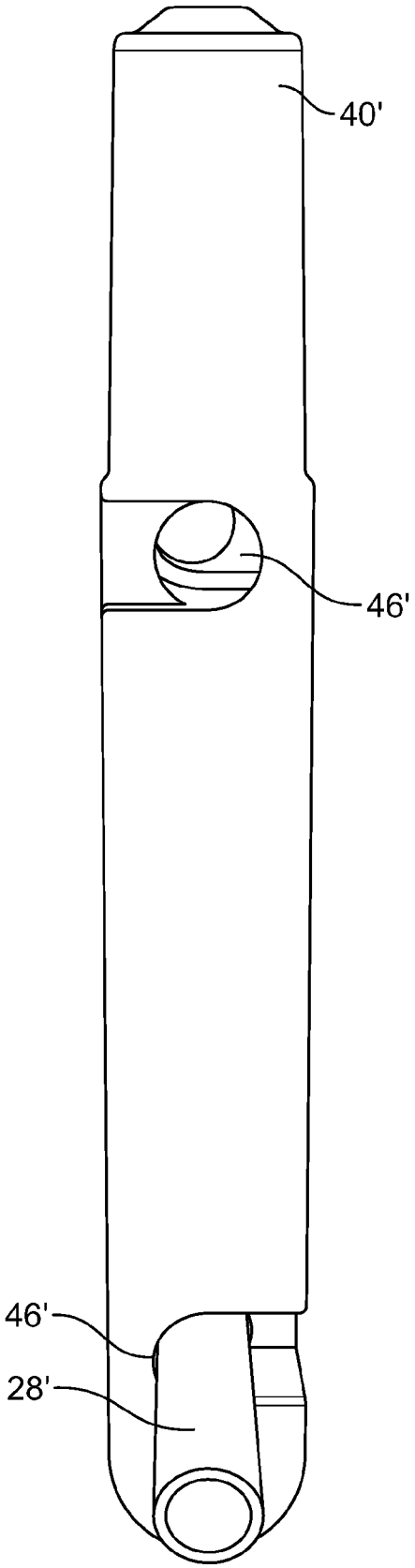
FIG. 18 shows a side view of the slide member and one of the slide bars of the drive mechanism shown in FIG. 15.
Figure 19:
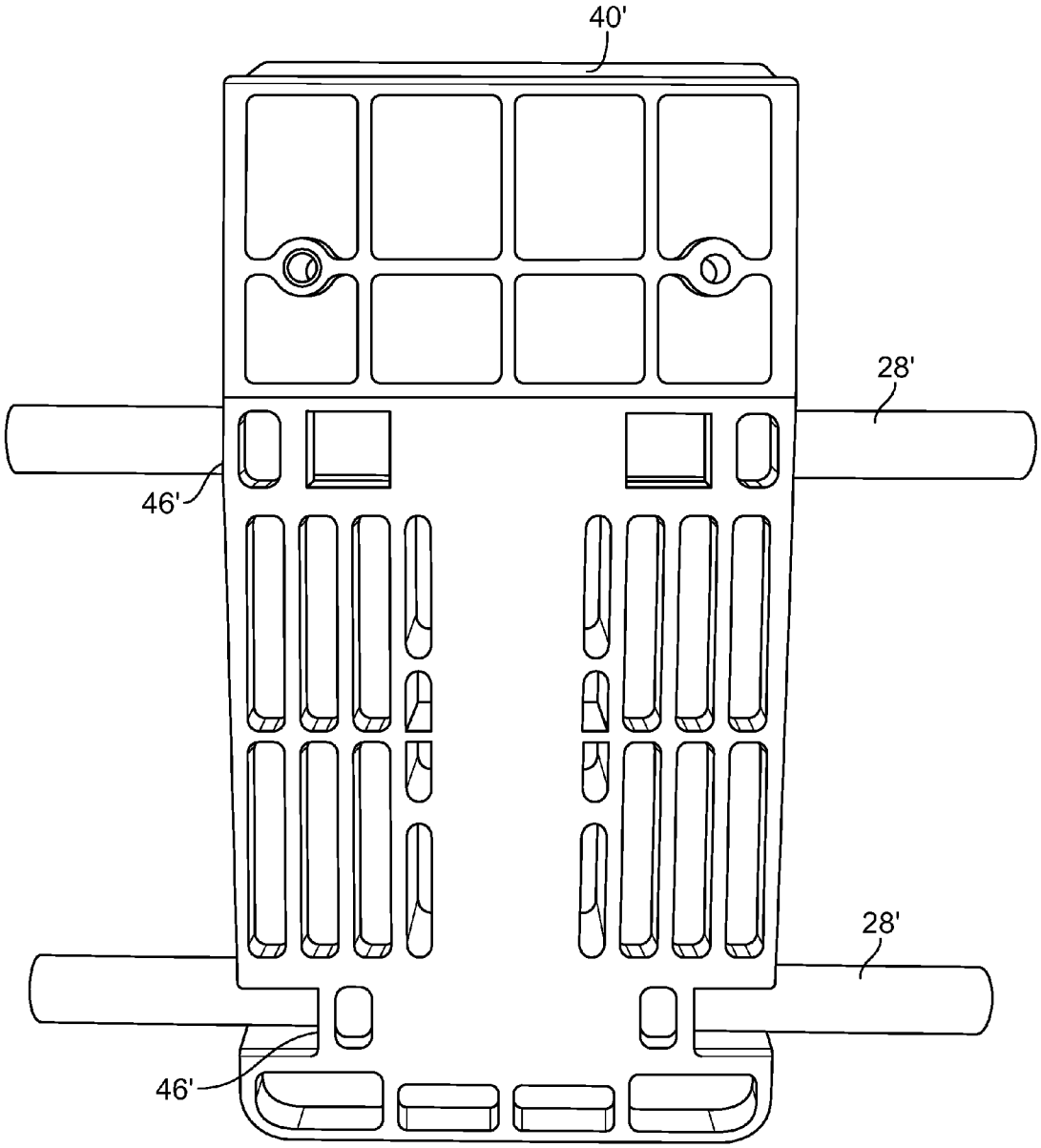
FIG. 19 shows a rear view of the slide member and slide bars of the drive mechanism shown in FIG. 15.

In the embodiment shown, first frame member 24, second frame member 26, cam arm 30, and slide member 40 are made of ABS plastic. Base plate 80 is shown as being made of a metal, such as steel. The support feet 82 on base plate 80, shown in FIG. 14, are made of rubber and provide for vibration isolation. Slide bar 28 is also shown as being a metal, such as stainless steel. However, one skilled in the art will appreciate that other materials are also possible.

Referring back to FIGS. 1 and 2, a knee rest 100 is shown. Knee rest 100 is for supporting the back of a user's knees while using the exercise machine 1. The knee rest can also aid in centering the arc through which a user's legs swing, preferably centering the arc in the pelvis region. As shown, knee rest 100 has an upper member 102 defining a top surface 104. In one embodiment, top surface 102 is rounded to have a contoured shape to make the knee support more comfortable for a user. As can be seen at FIG. 1, the upper member 102 of the knee rest 100 has a width W2 and a longitudinal axis X-X. In the embodiment shown, width W2 is about 14 inches which is slightly greater than the width W1 of the ankle rest 70. Longitudinal axis X-X is generally parallel to the longitudinal axis Y-Y of the ankle rest 70.

In the exemplary embodiment shown, the upper member 102 is connected to a base member 106 by a pair of support legs 110. Base member 106 is for supporting upper member and for providing a connection point between the knee rest 100 and the frame 80 of the housing 10. As shown, base member 106 has a pair of rubber support feet 108 for contacting the surface on which exercise device 1 rests. Support feet 108 also provide for vibration isolation. Base member 106 further includes a pair of collars 112 for receiving support legs 110. Support legs 110 are slidable within the collars 112 such that the upper member 102 of the knee rest 100 can be adjusted in a vertical direction V. By use of the term "vertical direction" is meant a direction that is generally perpendicular to the surface on which the exercise device 1 rests which is also the plane of the base plate 80. This adjustment allows an individual user to set the knee rest 100 height at a satisfactory level. In one position, the height of the upper member 102 is set to be lower than the height of the ankle rest 70 (i.e. axis X-X is lower in the horizontal plane than axis Y-Y). In the embodiment shown, upper member 102, base member 106, and support legs 110 are constructed from ABS plastic, although other materials and shapes may be used.

Figure 12:
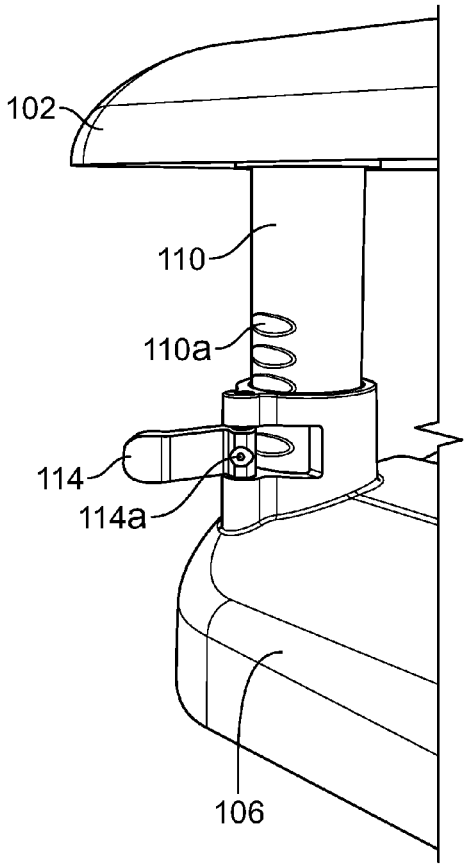
FIG. 12 shows a close up view of a collar and locking device suitable for use with knee rest on the exercise devices shown in FIGS. 1 and 9, wherein the locking device is in an unlocked position.
Figure 13:
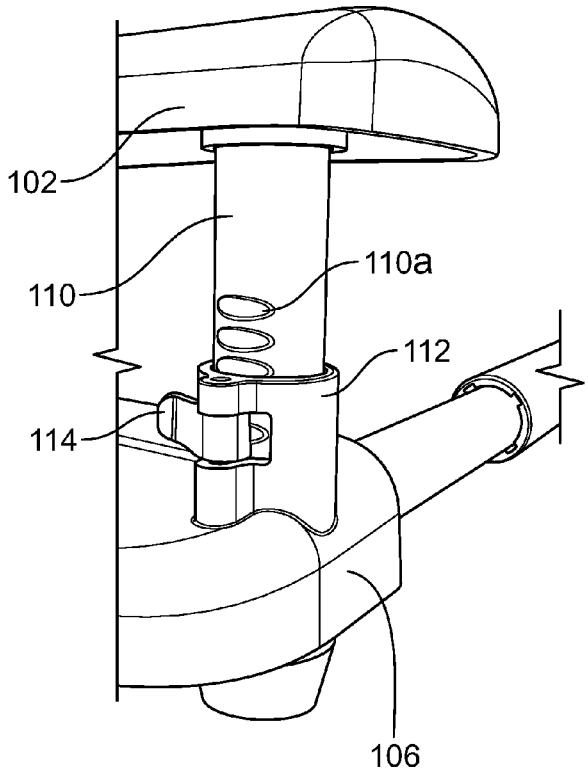
FIG. 13 shows a close up view of a collar and locking device suitable for use with knee rest on the exercise devices shown in FIGS. 1 and 9, wherein the locking device is in a locked position.

As shown, each collar 112 includes a locking mechanism 114 that operates to bind each leg 108 to the collar 112. This feature ensures that once the vertical height of the knee rest 100 is set, that it is securely retained in this position. In one embodiment, the legs 110 have a plurality of notches 110*a* for receiving a detent 114*a* on the locking mechanism 112. In one embodiment the locking mechanism 114 is a latch. However, those skilled in the art will appreciate that other means for locking the legs 110 may be used, such as pins. Referring to FIG. 12, the locking mechanism 114 is in an unlocked position. Referring to FIG. 13, the locking mechanism 114 is in a locked position. In the embodiment shown, collars 112 and locking mechanism 114 are primarily constructed from ABS plastic, although other materials may be used.

In the exemplary embodiment shown, the base member 106 of the knee rest 100 is connected to the base plate 80 of the housing 10 by a pair of extension legs 90. Extension legs are for horizontally spacing the knee rest 100 from the ankle rest 70 a desired distance such that the exercise device 1 can be adjusted to accommodate the particular leg length and proportions of a particular user.

As shown, each extension leg 90 includes an inner member 92 that is slideable within an outer member 94. The inner member 92 is received into recess 116 and secured by screws (not shown) while the outer member is shown as being secured to the base plate 80 via clamps 99. One skilled in the art will appreciate that inner and outer members 92, 94 may be respectively attached to the base member 106 and base plate 80 by a variety of means known in the art. In the embodiment shown, members 92, 94 are aluminum tubes. However, one skilled in the art will appreciate that other materials and shapes may be used.

Figure 10:
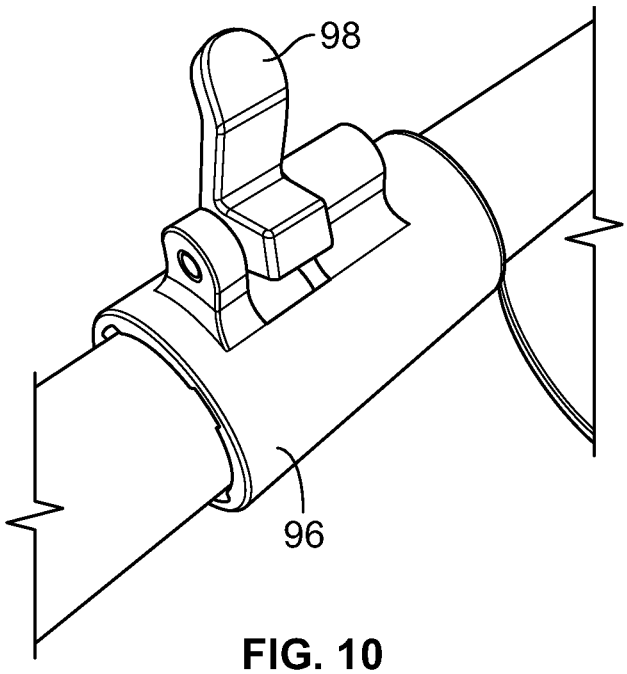
FIG. 10 shows a close up view of a collar and locking device suitable for use with the extension legs on the exercise devices shown in FIGS. 1 and 9, wherein the locking device is in an unlocked position.
Figure 11:
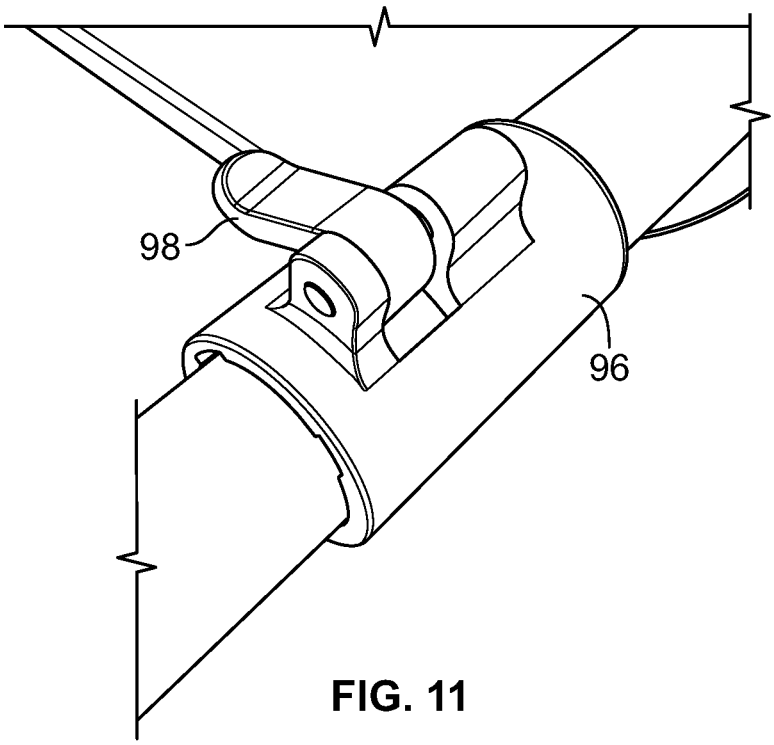
FIG. 11 shows a close up view of a collar and locking device suitable for use with the extension legs on the exercise devices shown in FIGS. 1 and 9, wherein the locking device is in a locked position.

Each extension leg 90 is also provided with a collar 96 having a locking mechanism 98. In the embodiment shown, collar 96 and locking mechanism 98 are secured to outer member 94 and configured such that locking mechanism can selectively engage the inner member 92. In one embodiment, locking mechanism 98 is a latch. However, those skilled in the art will appreciate that other means for locking the legs 110 may be used, such as pins. In the embodiment shown, collar 96 and locking mechanism 98 are primarily constructed from ABS plastic, although other materials may be used. Referring to FIG. 10, the locking mechanism 98 is shown in an unlocked position. FIG. 11 shows the locking mechanism 98 in a locked position.

By operation of the locking mechanism 98, the relative position of the inner member 92 to the outer member 94 may be set to a fixed position. Because the inner member 92 is slideable with respect to the outer member 94, the knee rest 100 position may be adjusted in a horizontal direction H such that the desired spacing between the knee rest 100 and the ankle rest is achieved (i.e. axis X-X is spaced a desired horizontal distance from axis Y-Y). By use of the term "horizontal direction" is meant a direction that is generally parallel to the surface on which the exercise device 1 rests and perpendicular to the longitudinal axis X-X of the leg rest 100.

Referring back to FIG. 1, an electrical connection 200 and a controller 300 are shown. Electrical connection 200 is for supplying power to the motor 22 of the exercise device 1 while controller 300 is for controlling the speed and operating period of the motor 22. In one embodiment, controller 300 includes a power button 302 for activating and deactivating the motor 22 and for setting the running time for the motor 22. A plurality of indicator lights 304 are provided on the controller 300 to show the selected running time period. In operation, a user can depress the power button 302 one, two, or three times to select a first, second, or third time period, for example, five, ten, or fifteen minutes. At the expiration of the time period, or upon depressing the power button 302 a fourth time, the motor 22 is deactivated. The controller 300 also includes a button 306 for increasing motor speed and a button 308 for decreasing motor speed via a speed controller 312. An indicator 304 may be provided to show the motor speed that is selected. In one embodiment, the motor 22 can be set to six different speeds. One skilled in the art will appreciate that other modes of operation are possible.

Referring to FIGS. 9-20, a second embodiment of an exercise device 1' is shown. Many of the features of the second embodiment are similar to those of the first embodiment shown in FIGS. 1-8. Therefore, the description of the first embodiment is incorporated by reference into the description of the second embodiment, and vice versa. Additionally, where features are similar, like numbers will be used. The following description of the second embodiment will primarily describe features that are different with respect to the first embodiment.

Figure 7:
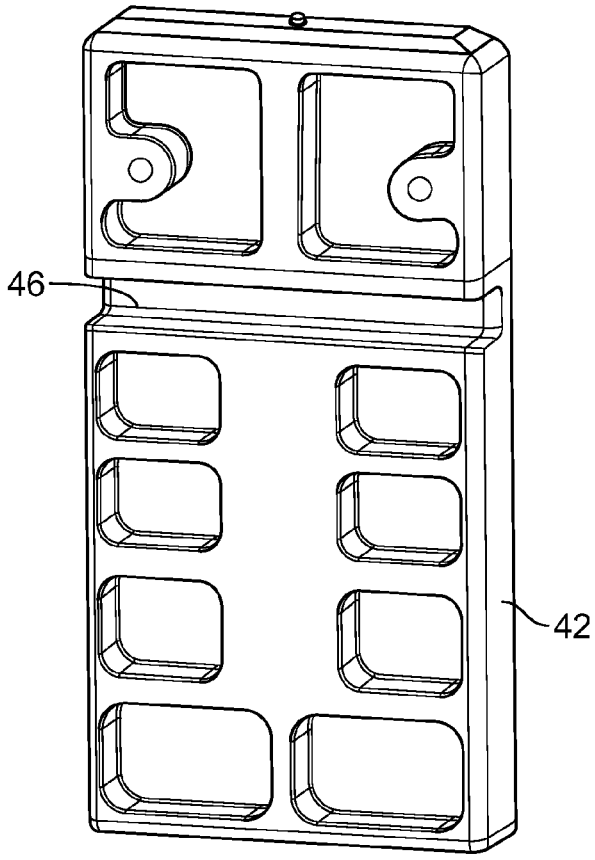
FIG. 7 is a front perspective view of a slide member of the drive mechanism shown in FIG. 2.
Figure 20:
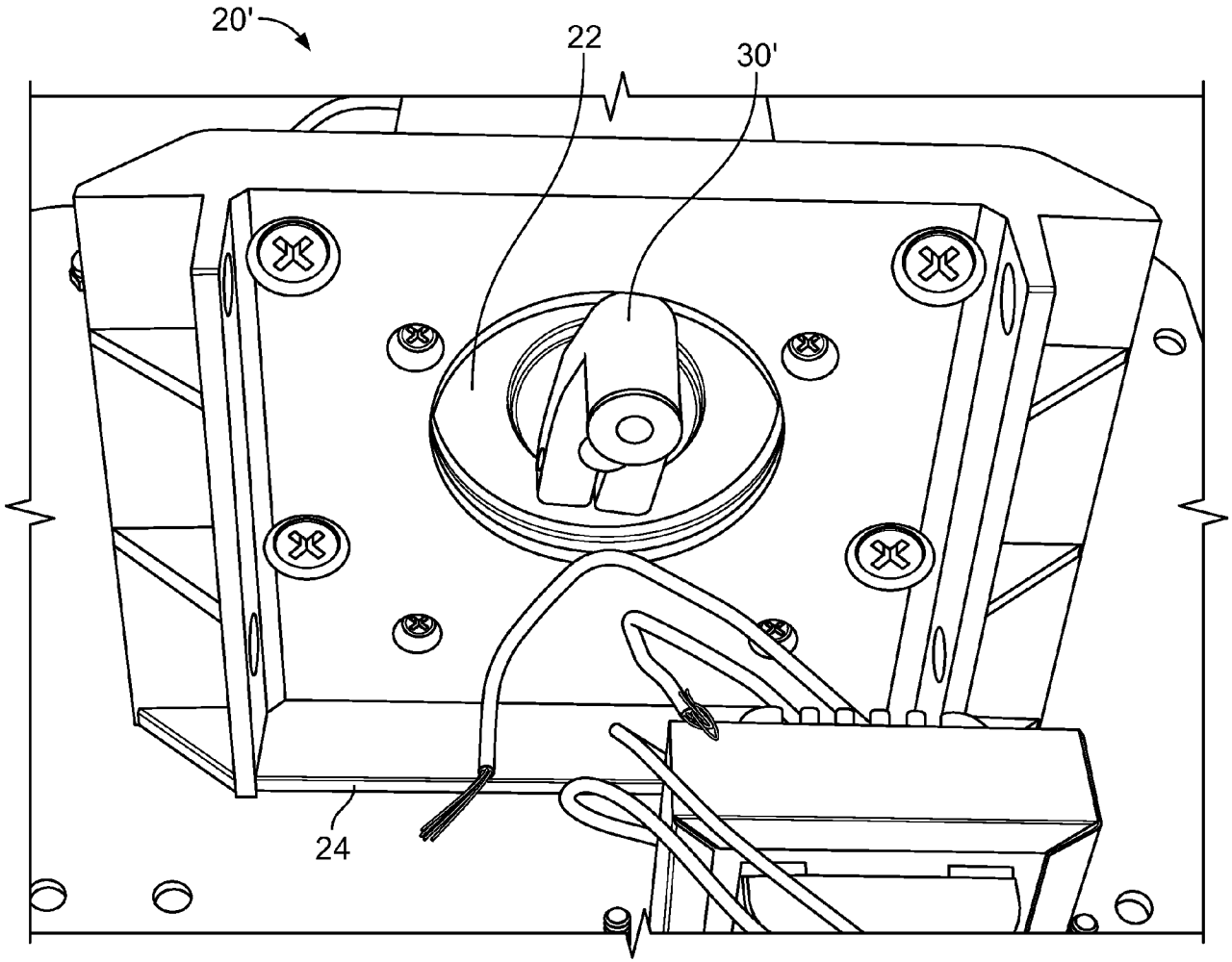
FIG. 20 shows a front perspective view of a portion of the drive mechanism shown in FIG. 15.

As can be seen at FIGS. 15-20, the slide member 40' is provided with a pair of transverse openings 46' instead of the single slot 46 shown in FIG. 7. The transverse openings 46' surround a pair of slide bars 28' that are locate above and below the slot 42. In contrast to the slot 46 shown in FIG. 7, the transverse openings 46' retain the slide member 40' onto the slide bars 28' such that the cam arm 30 is engaged into slot 42. This configuration eliminates the need for a second frame member 26. Additionally, the cam arm 30' shown in FIG. 20 is of a slightly different design in that no counterbalancing feature is present.

Various modifications and alterations of this disclosure will become apparent to those skilled in the art without departing from the scope and spirit of this disclosure, and it should be understood that the scope of this disclosure is not to be unduly limited to the illustrative embodiments set forth herein.

I claim:

1. An exercise device comprising:

a. a housing;

b. an ankle rest being located above the housing and having a first height, the ankle rest also having a top surface defining a pair of recesses configured to support a user's ankles, the ankle rest having a first width extending along a first longitudinal axis;

c. a drive mechanism disposed at least partially within the housing and connected to the ankle rest, the drive mechanism configured to move the ankle rest in a linear reciprocating side-to-side motion along the longitudinal axis of the ankle rest; and d. a knee rest configured to support a back of a user's knees, the knee rest comprising:

i. a horizontally adjustable base connected to the housing by a pair of telescoping tubes;

ii. a contoured top surface connected to the base by a pair of vertically sliding legs, the contoured top surface being vertically adjustable with respect to the base through the pair of vertically sliding legs such that that the contoured top surface can be adjusted to have a second height lower than the first height of the ankle rest;

iii. wherein the contoured top surface has a second width extending along a second longitudinal axis parallel to the first longitudinal axis, the second width being equal to or greater than the first width; and e. a controller in communication with the drive mechanism, the controller being configured to allow the user to activate and deactivate the drive mechanism and to control a speed of the drive mechanism while using the exercise device.

2. The exercise device of claim 1, further comprising clamping means for locking the knee rest in a fixed horizontal position.

3. The exercise device of claim 2, further comprising clamping means for locking the knee rest in a fixed vertical position.

4. The exercise device of claim 1, wherein the housing further comprises a base frame.

5. The exercise of device of claim 4, wherein the knee rest is connected to the base frame of the housing by the pair of telescoping tubes.

* * * * *